US009022108B2

(12) United States Patent
Chatelet et al.

(10) Patent No.: US 9,022,108 B2
(45) Date of Patent: May 5, 2015

(54) DEVICE FOR INTERVENTION IN A WELL COMPRISING A PYROTECHNIC SYSTEM, INSTALLATION AND METHOD ASSOCIATED THEREWITH

(75) Inventors: Vincent Chatelet, Le Blanc-Mesnil (FR); Axel Quignard, Paris (FR)

(73) Assignee: Geoservices Equipements, Paris Nord II, Roissy en France (FR)

( * ) Notice: Subject to any disclaimer, the term of this patent is extended or adjusted under 35 U.S.C. 154(b) by 384 days.

(21) Appl. No.: 13/574,244

(22) PCT Filed: Jan. 19, 2011

(86) PCT No.: PCT/EP2011/050691

§ 371 (c)(1),
(2), (4) Date: Sep. 14, 2012

(87) PCT Pub. No.: WO2011/089156

PCT Pub. Date: Jul. 28, 2011

(65) Prior Publication Data

US 2012/0325463 A1 Dec. 27, 2012

Related U.S. Application Data

(60) Provisional application No. 61/299,378, filed on Jan. 29, 2010.

(30) Foreign Application Priority Data

Jan. 19, 2010 (FR) ..... 10 50336

(51) Int. Cl.
*E21B 41/00* (2006.01)
*E21B 47/00* (2012.01)

(Continued)

(52) U.S. Cl.
CPC ..... *E21B 43/1185* (2013.01); *E21B 43/11857* (2013.01); *E21B 47/12* (2013.01); *F42D 1/05* (2013.01)

(58) Field of Classification Search
CPC ..... E21B 43/1185; E21B 43/11857; E21B 47/12; F42D 1/05
USPC ..... 166/250.01, 63, 297, 55, 55.1, 65.1; 361/56
See application file for complete search history.

(56) References Cited

U.S. PATENT DOCUMENTS 4,306,628 A 12/1981 Adams, Jr. et al.
6,105,688 A 8/2000 Vaynshteyn et al.

(Continued)

FOREIGN PATENT DOCUMENTS

GB 2352261 1/2001
WO 2008/100362 8/2008

*Primary Examiner* — Daniel P Stephenson
(74) *Attorney, Agent, or Firm* — Stephanie Chi

(57) ABSTRACT

A device including a lower assembly (30) and a cable (32) for deploying the lower assembly (30) in the well (12). The lower assembly (30) includes a pyrotechnic system (72), and a firing assembly further including a module (86) for controlling a power battery (88) and a power module (150). The control module (86) includes arming means (112; 158) of the power module (150) capable of connecting the power battery (88) to the power module (150) upon receiving an electrical arming signal transmitted through the cable (32). It includes means (114; 160) for triggering the pyrotechnic system (72) capable of connecting the power module (150) to the pyrotechnic system (72), upon receiving a distinct electrical triggering signal posterior to the arming signal.

16 Claims, 5 Drawing Sheets

(51) Int. Cl.

| | |
|---|---|
| ***E21B 47/12*** | (2012.01) |
| ***E21B 43/1185*** | (2006.01) |
| ***F42D 1/05*** | (2006.01) |

(56) References Cited

U.S. PATENT DOCUMENTS

| | | | | |
|---|---|---|---|---|
| 6,179,064 | B1 | 1/2001 | Vaynshteyn | |
| 2002/0088620 | A1 | 7/2002 | Lerche et al. | |
| 2004/0108114 | A1* | 6/2004 | Lerche et al. | 166/302 |
| 2005/0045331 | A1 | 3/2005 | Lerche et al. | |
| 2009/0159285 | A1* | 6/2009 | Goodman | 166/297 |
| 2010/0051265 | A1* | 3/2010 | Hurst et al. | 166/250.01 |
| 2010/0286800 | A1* | 11/2010 | Lerche et al. | 700/90 |
| 2011/0127028 | A1* | 6/2011 | Strickland | 166/55.1 |
| 2012/0037027 | A1* | 2/2012 | Nelson et al. | 102/215 |
| 2012/0325463 | A1* | 12/2012 | Chatelet et al. | 166/250.01 |

* cited by examiner

DEVICE FOR INTERVENTION IN A WELL COMPRISING A PYROTECHNIC SYSTEM, INSTALLATION AND METHOD ASSOCIATED THEREWITH

FIELD

The present disclosure relates to a method and device for intervention in a well and, more particularly, relates the firing of a pyrotechnic system with the use in a slickline system.

BACKGROUND

Certain downhole tools such as perforation tools, cutting torches, cementation tools, tools for linings or anchoring tools are often actuated by firing a pyrotechnic system. Such systems typically comprise an explosive charge or an inflammable solid notably for generating a force or/and heat power intended to carry out the operation In order to carry out such operations safely, the use of an electrical stranded cable is known for lowering the pyrotechnic system into the well. The electrical cable is connected at the surface to an electric power supply unit capable of delivering sufficient power in order to trigger the firing. When the pyrotechnic system has to be triggered, the electric power is transmitted from the surface through the cable right down to the pyrotechnic system.

Such an intervention device is rather costly. Further it is relatively difficult to apply because of the seal to be achieved at the surface, at the head of the well.

In order to reduce the cost of the operation and to facilitate the making of the seal at the surface, it is known how to lower the charge by means of cables of the "piano string" type, designated by the term of slickline.

Such cables are very resistant mechanically. However, the charge has to be triggered by means of a countdown system associated with an acceleration, pressure, temperature sensor in the lower assembly, which makes its triggering not very accurate.

Additionally the safety of the operators at the surface is not guaranteed, since there exists no means for checking that the charge has actually exploded when the lower assembly is moved up to the surface.

In order to overcome this problem, U.S. Pat. No. 6,179,064 describes a device of the aforementioned type, wherein a lower assembly comprising a perforation tool, a detonator and control means is lowered into the bottom of a well for example by means of a cable working line. The lower assembly includes a power battery capable of electrically powering a power module in order to trigger the charge, upon receiving a signal from the surface.

The triggering signal is for example a hydrostatic signal sent into the fluid present in the well around the lower assembly. Alternatively, the signal is a mechanical signal resulting from a predetermined movement of the lower assembly at the bottom of the well.

Once the charge has exploded, the control module sends a confirmation signal to the surface, this signal being transmitted by means of a valve allowing a hydrostatic signal to be generated. Such a device therefore improves the safety of the operators.

However, this device remains complicated to apply, since it requires hydrostatic communication means between the bottom and the surface.

An object of the disclosure is therefore to obtain a device for triggering a pyrotechnic system intended to be lowered into a well, which is very simple to apply, while guaranteeing maximum safety for the operators.

SUMMARY

According to one aspect of the disclosure, a device for intervention in a well (12) is provided. The device includes a lower assembly intended to be lowered into the well, the lower assembly including at least one pyrotechnic system, and an assembly for firing the pyrotechnic system, the firing assembly comprising a power module having an output intended to be electrically connected to the pyrotechnic system in order to cause firing of the pyrotechnic system, and a power battery intended to be connected to an input of the power module in order to provide the electric power required for the power module, the firing assembly further including a module for controlling the power module; and a cable for deploying the lower assembly in the well, electrically connected to the control module.

The control module includes a first detection means capable of determining if a voltage above a first threshold value is provided by the power battery to the power module; means for arming the power module capable of connecting the power battery to an input of the power module in order to apply an electrical voltage at the input of the power module, upon receiving an electrical arming signal transmitted from the surface through the deployment cable; and means for triggering the pyrotechnic system capable of connecting an output of the power module to the pyrotechnic system in order to supply an output voltage capable of generating the firing of the pyrotechnic system, upon receiving a distinct electrical triggering signal posterior to the arming signal, the triggering signal being transmitted from the surface through the deployment cable.

The device according to the disclosure may comprise one or more of the following features, taken individually or according to any technically possible combinations:

the control module comprises second detection means capable of determining whether a voltage above a second threshold value has been produced at the output of the power module and a third detection means capable of determining whether an electric current for powering the pyrotechnic system above a third threshold value has flowed via the power module between the battery and the pyrotechnic system, after the sending of the triggering signal;

the control module includes a programmable logic control, circuit advantageously of the FPGA type, capable of making a transition from an initial state to a first state for actuating the arming means of the power module upon receiving the electrical arming signal and then to a second state for actuating the triggering means upon receiving the electrical triggering signal, the transition of the card to the second actuation state only being possible after the card has made a transition to the first actuation state;

the arming means comprise at least one first logic gate of the logic circuit and the triggering means comprise at least one second logic gate of the logic circuit;

the control module includes at least one first controller, and at least one second controller mounted in parallel on the first controller, the first controller and the second controller respectively receiving in parallel an electrical arming signal so as to transmit it to the arming means, the arming means being actuated upon receiving at least either one of the arming signals from the first controller and the second controller, and in that the first controller and the second controller receive in parallel the triggering signal for transmitting it to the triggering means, the triggering means being actuated upon receiving at least either one of the triggering signals from the first controller and from the second controller;

a fuse is electrically interposed between the power battery and the power module in order to prevent the powering of the power module by the power battery when the fuse is open, the control module comprising means for controlling the opening of the fuse;

the means for controlling the opening of the fuse are capable of being actuated upon receiving a fuse-opening signal from the surface through the cable;

the means for controlling the opening of the fuse are capable of being actuated when at least one of the first controller and of the second controller has a fault;

the control module is electrically powered by an auxiliary battery borne by the lower assembly, and distinct from the power battery, the control module comprising fourth means for indicating the presence of a voltage at the output of the auxiliary battery, the means for controlling the opening of the fuse being capable of actuating the opening of the fuse when the fourth indication means detect a voltage below a threshold value on the terminals of the auxiliary battery;

the means for controlling the opening of the fuse are capable of being actuated in the absence of receiving by the control module a communications signal from the surface through the cable over a predetermined period of time;

the lower assembly includes at least one mechanical switch positioned in series between the power battery, the power module and the pyrotechnic system, said or each mechanical switch being capable of spontaneously closing when the temperature and/or the pressure applied on the switch are greater than a determined temperature and/or pressure;

the deployment cable has a smooth outer surface, the cable comprising a solid metal core and an electrically insulating sheath defining the smooth outer surface of the cable, the core having a breaking strength greater than 300 daN and an electrical linear resistance greater than 30 mohms/m, the electrical arming signal and the electrical triggering signal being conveyed through the cable;

the arming means comprise an arming control unit capable of toggling an upstream switch interposed between the power battery and the power module between an open configuration in which the power battery does not electrically power the power module and a closed configuration in which the power battery electrically powers the power module, upon receiving the arming signal; and the triggering means comprise a triggering control unit, advantageously distinct from the arming control unit, the triggering control unit being capable of toggling the power module between an inactive state and an active state in which it provides the pyrotechnic system with an output voltage greater than the input voltage applied by the power battery, upon receiving the triggering signal.

The object of the disclosure is also an installation for intervention in a well, characterized in that it includes a device as defined above, and a surface assembly including means for transmitting an electrical arming signal and a distinct triggering signal posterior to the arming signal, the transmission means being electrically connected to the cable.

The installation according to the disclosure may comprise the following feature:

it includes an interface for controlling the transmission means and a mechanical switch interposed between the transmission means and the cable, the mechanical switch being advantageously manoeuvred by a control key between a position for electrically connecting the transmission means with the cable and a position for disconnecting the transmission means from the cable.

The object of the disclosure is further a method for triggering a pyrotechnic system in a well of the type comprising the following steps:

providing a device as defined above;

lowering the lower assembly into the well by means of the deployment cable;

detecting with the first detection means a voltage threshold applied at the input of the power module;

sending an electrical arming signal from the surface, and transmitting this electrical arming signal towards the control module through the cable;

actuating the arming means and powering on the power module with the power battery in order to apply an electrical arming voltage to an input of the power module;

transmitting a distinct electrical triggering signal posterior to the arming signal from the surface, and transmitting this electrical triggering signal towards the control module through the deployment cable;

actuating triggering means and electrically powering the pyrotechnic system with the power module in order to generate the firing of the pyrotechnic system;

detecting with detection means a voltage threshold applied at the output of the power module;

detecting with detection means an intensity threshold of an electrical current flowing between the battery and the pyrotechnic system.

BRIEF DESCRIPTION OF THE DRAWINGS

The disclosure will be better understood upon reading the description which follows, only given as an example and made with reference to the appended drawings, wherein.

DETAILED DESCRIPTION

Figure 1:
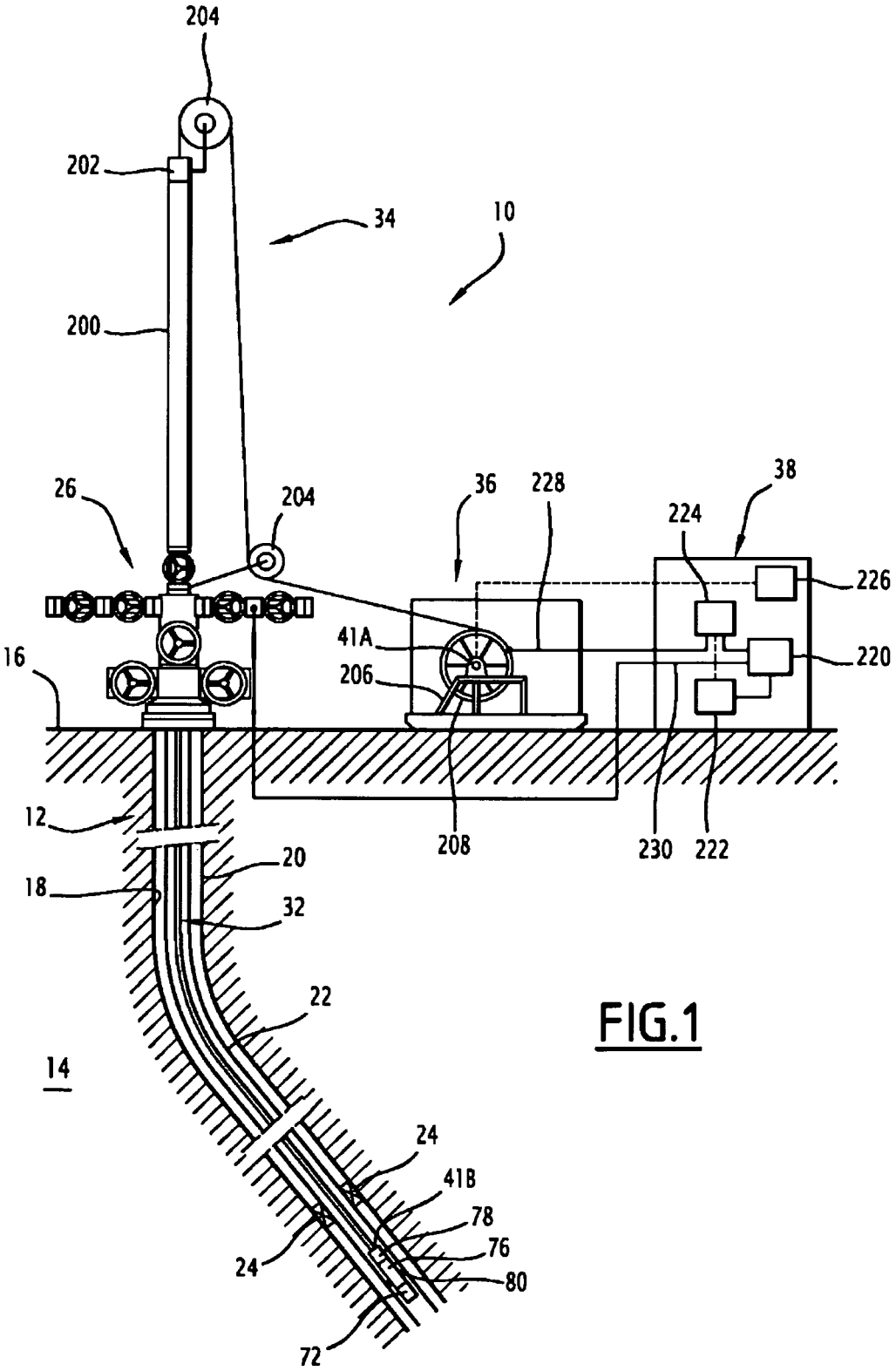
FIG. 1 is a schematic sectional view along a vertical median plane of an intervention installation comprising a first intervention device according to the disclosure.

A first intervention installation 10 according to the disclosure is illustrated in FIG. 1. This installation 10 is intended to perform operations in a fluid production well 12 made in the subsoil 14.

These operations are applied by means of a pyrotechnic system for carrying out actions at the bottom of the well 12, such as perforations, cuttings by means of a torch, cementation operations, or further operations for setting tools into place such as setting into place a seal gasket or anchoring of a tool.

These interventions are carried out in any point of the well 12, from the surface 16.

The fluid produced in the well 12 is for example a hydrocarbon such as petroleum or natural gas or another effluent, such as steam or water. Alternatively, the well is an "injector" well into which liquid or gas is injected.

The well 12 is made in a cavity 18 positioned between the surface 16 of the ground and the fluid layer to be exploited (not shown) located in depth in a formation of the subsoil 14.

The well 12 generally includes an outer tubular duct 20, designated by the term of "casing", and formed for example by an assembly of tubes applied against the formations of the subsoil 14. Advantageously, the well 12 includes at least one inner tubular duct 22 with a smaller diameter mounted in the outer tubular duct 20. In certain cases, the well 12 is without any duct 22.

The inner tubular duct 22 is generally designated as "production tubing". It is advantageously formed with a metal assembly of metal tubes. It is wedged inside the outer tubular duct 20 for example by linings 24.

The well 12 includes a well head 26 at the surface which selectively closes the outer tubular duct 20 and said or each inner tubular duct 22. The well head 26 includes a plurality of selective access valves inside the outer tubular duct 20 and inside the inner tubular duct 22.

The intervention installation 10 includes an intervention device comprising an intervention and measurement lower assembly 30 intended to be lowered into the well 12 through the inner tubular duct 22, and a cable 32 for deploying the lower assembly 30 in the well 12.

The intervention installation 10 further includes a sealing and alignment assembly 34 of the cable 32, mounted on the well head 26, an assembly 36 for deploying the cable 32, positioned in the vicinity of the well head 26, and a control unit 38.

In a so-called "open well" or "open hole" alternative, the assembly 34 is exclusively an assembly for aligning the cable, without any sealing means.

Figure 2:
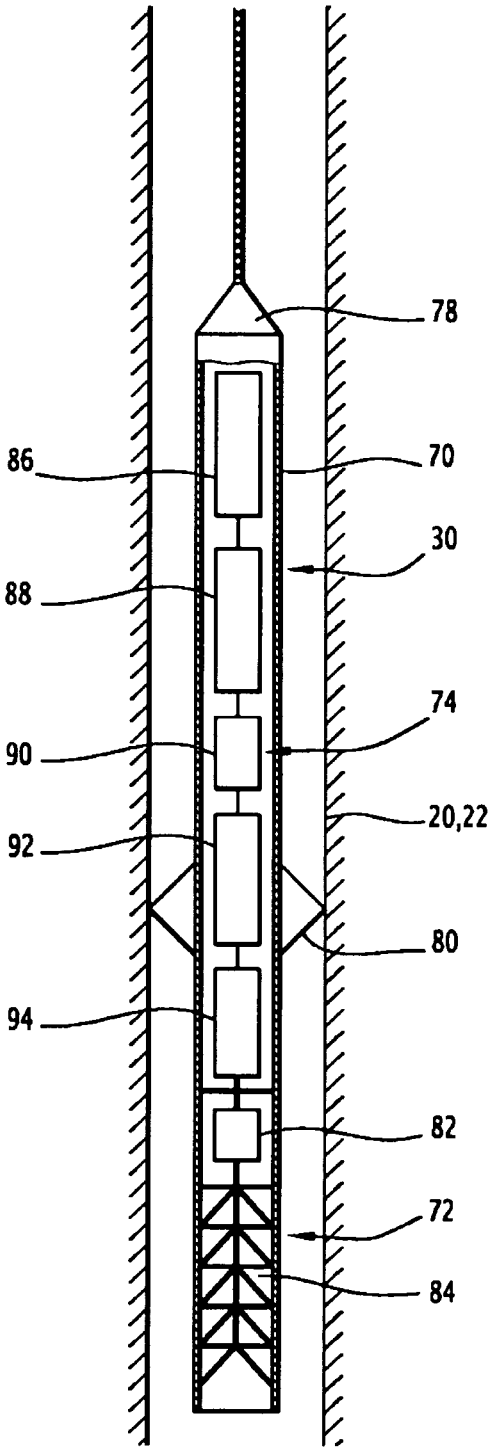
FIG. 2 is a schematic partial sectional view of the intervention device.

As illustrated by FIG. 2, the cable 32 is a cylindrical solid cable having a smooth outer surface 40.

The cable 32 extends between an upper end 41A, attached on the deployment assembly 36 at the surface, and a lower end 41B, intended to be introduced into the well 12. The lower assembly 30 is suspended from the lower end 41B of the cable 32.

The length of the cable 32, taken between the ends 41A, 41B is greater than 1,000 m and is notably greater than 1,000 m and comprised between 1,000 m and 10,000 m.

The cable 32 has an outer diameter of less than 8 mm, advantageously less than 6 mm.

The cable 32 includes a central metal core, and an insulating outer sheath applied around the central core.

The central core is advantageously covered with an outer metal layer.

The central core is formed by a single strand of solid metal cable, designated by the term "piano chord" and sometimes by the term of "slickline cable".

The metal material forming the core is for example electroplated or stainless steel. This steel for example comprises the following components in mass percentages:

Carbon: between 0.010% and 0.100%, advantageously equal to 0.050%;

Chromium: between 10% and 30%, advantageously equal to 15%;

Manganese: between 0.5% and 3%, advantageously equal to 1.50%;

Molybdenum: between 1.50% and 4%, advantageously equal to 2%;

Nickel: between 5% and 20%, advantageously equal to 10%;

Phosphorus: less than 0.1%, advantageously less than 0.050%;

Silicon: less than 1% advantageously less than 0.8%;

Sulphur: less than 0.05% advantageously less than 0.03%;

Nitrogen less than 1%, advantageously less than 0.5%.

This steel is for example of the 5R60 type.

The core is solid and homogeneous over the whole of its thickness. It has a smooth outer surface on which is applied an outer metal layer when it is present.

The diameter of the core is typically comprised between 1 mm and 5 mm, advantageously between 2 mm and 4 mm, and is for example equal to 3.17 mm, i.e. 0.125 inches.

The core has a breaking strength of more than 300 daN, and notably comprised between 300 daN and 3,000 daN, advantageously between 600 daN and 2,000 daN.

The core further has a relatively high electrical linear resistance of more than 30 mohms/m, and for example comprised between 50 mohms/m and 150 mohms/m.

The core has sufficient flexibility so as to be wound without any significant plastic deformation on a drum with a diameter of less than 0.8 m.

The outer sheath forms an annular sleeve applied on the core, over the whole periphery of the core, on substantially the whole length of the cable 32, for example on a length of more than 90% of the length of the cable 32, taken between its ends 41A, 41B.

The outer sheath thus has a cylindrical inner surface applied against the central core and a smooth outer surface delimiting the smooth outer surface of the cable 32.

The thickness of the sheath is advantageously comprised between 0.2 mm and 2 mm.

The outer sheath includes a polymer matrix.

The matrix is made on the basis of a polymer such as a fluoropolymer of the fluorinated ethylene propylene type (FEP), perfluoroalkoxyalkane, polytetrafluoroethylene (PTFE), perfluoromethylvinylether, or on the basis of a polyketone such as polyetheretherketone (PEEK) or polyetherketone (PEK), or on the basis of epoxy, optionally taken as a mixture with a fluoropolymer, or further based on polyphenylene sulfite polymer (PPS), or mixtures thereof.

Advantageously, the polymer matrix is made in polyetheretherketone (PEEK).

The outer sheath optionally comprises mechanical reinforcement fibres embedded in the polymer matrix.

As illustrated by FIG. 2, the lower assembly 30 comprises a hollow case 70 comprising at least one pyrotechnic system 72, and an assembly 74 for firing said or each system 72, capable of being controlled from the surface by electrical signals transmitted through the cable 32.

The case 70 is of a generally tubular shape. It is connected to the cable 32 through a mechanical and electrical connecting head 78. The case 70 advantageously includes a plurality of centralizers 80 protruding radially so as to be applied onto the wall of the duct 20, 22 and to achieve electrical contact with this wall.

In the alternative illustrated in FIG. 2, the pyrotechnic system 72 comprises a detonator 82 and at least one explosive charge 84.

The detonator 82 is capable of causing detonation of the charge, when it is electrically powered by the firing assembly 74, as this will be described in detail below. Alternatively, the pyrotechnic system 72 is formed by a flammable solid electrically connected to the firing assembly so as to be set on fire upon receiving a supply of electrical power produced by the firing assembly 74.

According to the disclosure, the firing assembly 74 includes a communications and control module 86, a power battery 88 and an electrical power generator 92.

The firing assembly 74 further includes an upstream safety module 90 interposed between the power battery 88 and the generator 92, the upstream module 90 including a fuse, and a downstream safety module 94 interposed between the generator 92 and the pyrotechnic system 72.

Figure 3:
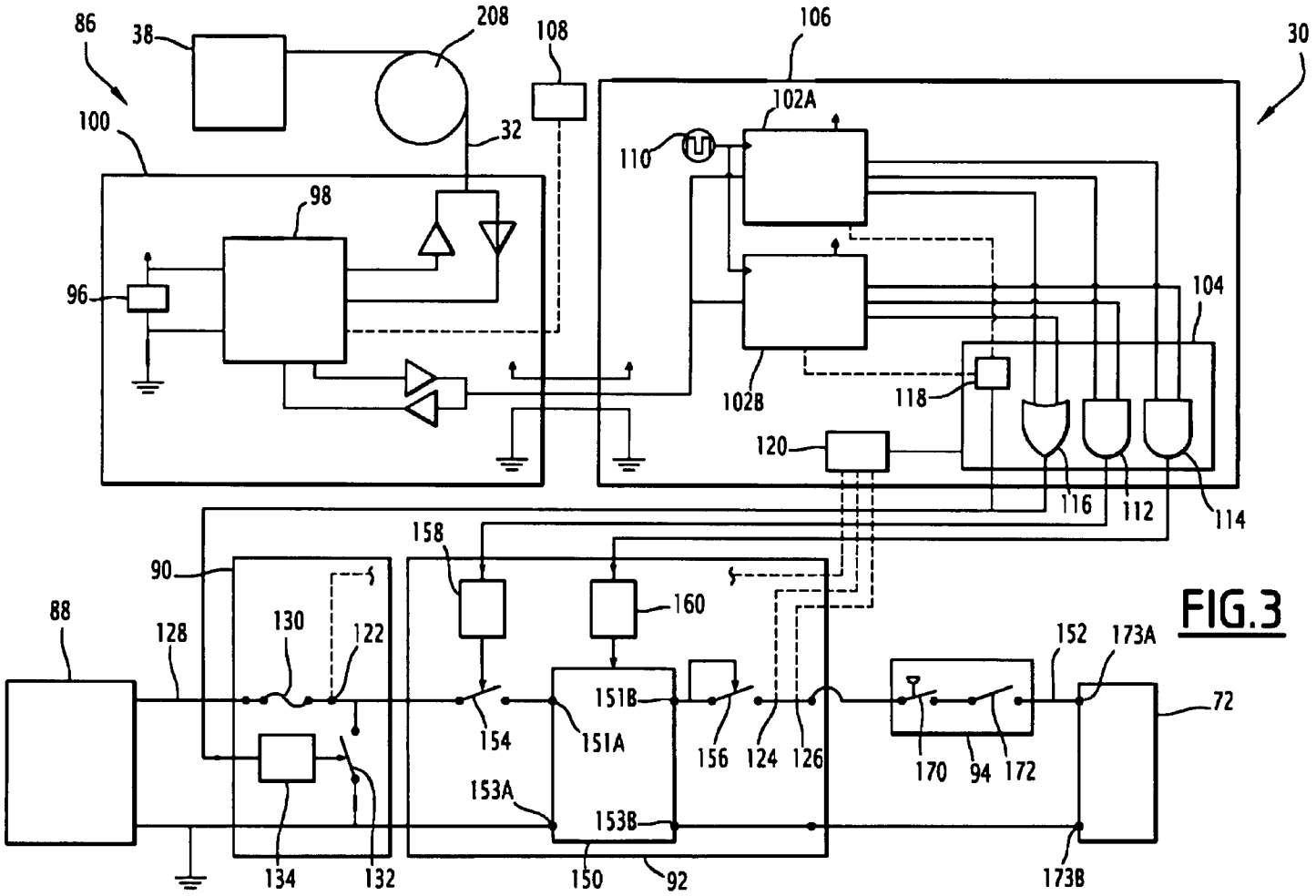
FIG. 3 is a schematic basic view of the main electrical components of the device of FIG. 1.

As illustrated by FIG. 3, the communications and control module 86 in this example includes an auxiliary battery 96, and a communications unit 98 borne by a first control card 100.

The module 86 further includes a pair of microcontrollers 102A, 102B mounted in parallel, and a programmable logic circuit 104, advantageously of the FPGA type, electrically connected upstream to the microcontrollers 102A, 102B and downstream to the power generator 92.

The auxiliary battery 96 is electrically connected to the communications unit 98 in order to electrically power this unit 98. Further it is capable of electrically powering the microcontrollers 102A, 102B and the programmable logic circuit 104.

Thus, the whole electrical power required for operating the communications and control module 86 is provided in a self-contained way by the auxiliary battery 96.

The communications unit 98 is electrically connected to the core 48 of the cable. It includes at least one transceiver capable of receiving electrical communications signals transmitted from the control unit 38 at the surface through the cable 32 and of transmitting electrical communication signals towards the control unit 38 through the cable 32.

As this will be seen below, the electrical communications signals from the surface to the bottom notably comprise an electrical arming signal of the generator 92, transmitted from the surface, and an electrical signal for triggering the pyrotechnic system 72 transmitted from the surface after transmission of the electrical arming signal. The electrical communication signals also comprise an electrical signal for opening the fuse.

The communications unit 98 further comprises means for transmitting the electrical communication signals received from the surface to the microcontrollers 102A, 102B, and then to the programmable logic circuit 104 with view to arming and triggering the explosive charge, or to opening a fuse, as this will be seen below.

The voltage generated by the auxiliary battery 96 is greater than 1.5 volts and is less than 7.5 volts. This voltage is advantageously comprised between 2 volts and 6 volts. In an advantageous alternative, the unit 100 is further electrically connected to measurement sensors 108 positioned in the lower assembly 30.

The sensors 108 are for example sensors for detecting a physical quantity such as temperature, pressure, flow rate, depth, status of a depth valve, natural radiation of the ground (gamma rays), localisation of the tubing gaskets ("casing collar locator") or other measuring sensors.

The communications unit 98 is capable of collecting electric signals transmitted by the sensors 108 and of transferring them towards the control unit 38 at the surface through the cable 32.

The microcontrollers 102A, 102B are analogous structures. They are each connected to the communications unit 98 in order to each receive the electrical arming signal transmitted from the surface unit 38 and the electrical triggering signal transmitted after the arming signal from the surface unit 38.

They are capable of decoding and of transmitting the arming signal and the triggering signal respectively towards the programmable logic circuit 104.

Each microcontroller 102A, 102B is connected to a same clock 110 as well as the circuit 104. The microcontrollers 102A, 102B are each capable of transmitting at regular intervals, a signal for confirming reception of the periodic pulses generated by the clock 110.

The circuit 104 thus has a first logic gate 112 of the "AND" type intended for arming the power module, a second logic gate 114 of the "AND" type intended for triggering the pyrotechnic system and a third safety logic gate 116 of the "OR" type, intended to be connected to the upstream safety module 90, as this will be seen below.

The programmable logic circuit 104 further has a synchronisation system 118 and a state detection component 120 which will be described in detail below.

The first gate 112 is electrically connected to the first microcontroller 102A and to the second microcontroller 102B through electrical and disjoint logic paths.

Upon receiving two separate arming signals transmitted by the first microcontroller 102A and by the second microcontroller 102B, respectively, it is capable of transmitting an arming control signal which is conveyed towards the power generator 92.

The second gate 114 is electrically connected through electrical disjoint logic paths to the first microcontroller 102A and to the second microcontroller 102B.

Upon receiving two separate triggering signals transmitted by the first controller 102A and by the second controller 102B, respectively, it is capable of transmitting a triggering control signal which is conveyed to the power generator 92.

The third gate 116 is electrically connected to the first microcontroller 102A and to the second microcontroller 102B. Upon receiving at least one fuse-opening signal, received from one of the first microcontroller 102A and of the second microcontroller 1026, it is capable of transmitting a fuse-opening control signal to the upstream safety module 90.

The synchronization system 118 is of the watchdog type.

This system 118 is electrically connected to the first microcontroller 102A and to the second microcontroller 102B respectively in order to receive the pulses transmitted by these microcontrollers 102A, 102B, respectively in response to the signals transmitted by the clock 110.

The system 118 is capable of producing a fuse-opening signal if at least one of the two microcontrollers 102A, 102B no longer transmits a synchronisation pulse, or if the clock of the microcontrollers is no longer operating.

As this will be seen below, the detection component 120 includes a first sensor 122 for indicating an applied voltage at the input of the power generator 92 by the power battery 88, a second sensor 124 for indicating a voltage transmitted at the output of the power generator 92 and a third sensor 126 for indicating a current flowing between the power generator 92 and the pyrotechnic system 72.

The power battery 88 is capable of delivering an electrical voltage of more than 15 volts and an intensity of more than 1 ampere. It thus has a rated power of more than 15 watts.

The battery 88 for example consists of a plurality of electrical voltage sources mounted in series and/or in parallel, received in a case. It optionally comprises an internal fuse received in the case.

The battery 88 comprises a first terminal electrically connected to the power generator 92 via an upstream electrical line 128 through the upstream safety module 90. It comprises a second terminal electrically connected to the electrical ground of the system, advantageously the chassis of the lower assembly or the frame of the tool.

The upstream safety module 90 includes a fuse 130, a switch 132, for triggering the opening of the fuse 130 and a unit 134 for controlling the switch 132.

The fuse 130 is mounted in series on the upstream electrical line 128, outside the case of the battery 88. It is removably mounted on this line 128 so as to be able to be replaced after its opening.

The fuse 130 is for example formed by a calibrated meltable metal wire. The fuse 130 is capable of being opened when the intensity of the electric current flowing on the line 128 is greater than a determined rated intensity for example comprise between 4 amperes and 10 amperes.

The switch 132 connects an output of the fuse 130 located on the line 128 to the electrical ground. It is capable of being controlled between an open configuration and a closed configuration in which a short circuit is achieved between the power battery 88, the fuse 130, a low value resistor (not shown), the switch 132 and the electrical ground. In the closed configuration of the switch 132, the intensity of the electric current flowing in the fuse 130 is greater than the rated intensity for opening this fuse 130, which causes its opening.

The control unit 134 is for example formed by an optocoupler or by a transistor. It is electrically connected to the third gate 116. When the third gate 116 transmits a control signal for opening the fuse, the unit 134 causes toggling of the switch 132 from an open configuration to a closed configuration.

The power generator 92 includes a power module 150 having a first input 151A intended to be connected to the power battery 88 through the upstream line 128 and a first output 151B intended to be connected to the pyrotechnic system 72 through a downstream line 152 extending through the downstream safety module 94.

The power module 150 further includes a second input 153A and a second output 153B connected to electrical ground.

The power generator 92 further includes an upstream switch 154 mounted on the upstream line 128 downstream from the fuse 130 and a downstream switch 156 mounted on the downstream line 152.

The upstream switch 154 is mounted between the fuse 130 and the power module 150. It is connected to an arming control unit 158 for example formed by an optocoupler or by a transistor. The control unit 158 is electrically connected to the first gate 112. When the first gate 112 transmits an arming control signal, the unit 158 causes toggling of the switch 154 from an open configuration to a closed configuration.

The power module 150 comprises a voltage converter for example formed by a Switched Mode Power Supply or designated as SMPS.

This converter is capable of increasing an input voltage received from the power battery 88 between its inputs 151A and 153A via the upstream line 128 in order to provide at the output on the downstream line 152, a greater output voltage between its outputs 151B, 153B. Thus, the module 150 for example comprises a converter of the flyback type, of the boost type, or of the forward type.

The power module 150 is capable of being controlled between an inactive state in which its output voltage is less than its input voltage, and an active state with an increase in voltage by a triggering control unit 160.

Thus, in the active state, the voltage provided by the battery 88 at the input of the module 150 may be increased by at least 500%, or even by at least 1,000% or further by at least 1,150% at the output of the module 150 so as to pass from a minimum input voltage of 15 volts to a maximum output voltage of 250 volts.

The control unit 160 is for example formed by an optocoupler or a transistor as described earlier.

It is electrically connected to the second gate 114. When the second gate 114 transmits a triggering control signal, the unit 160 toggles the converter 150 from its inactive state to its active state.

The downstream switch 156 is a threshold switch. It is capable of passing from its open configuration to a closed configuration when the voltage at the output of the converter 150, taken between its outputs 151B, 153B is greater than a predetermined threshold value, for example greater than 80% of the output voltage required for electrically powering the pyrotechnic system 72.

The downstream safety module 94 includes a first mechanical switch 170 controllable by pressure and a second mechanical switch 172 controllable by temperature.

The switches 170, 172 are mounted in series on the downstream line 152 downstream from the switch 156, and upstream from the pyrotechnic system 72.

The switch 170 is capable of toggling in a self-contained way between an open configuration and a closed configuration when the pressure exerted on the switch 170 is greater than a threshold pressure.

The switch 172 is capable of spontaneously toggling from an open configuration to a closed configuration, when the temperature applied on the switch 172 is above a threshold temperature.

The downstream line 152 is electrically connected downstream from the downstream module 94 to a first input 173A of the pyrotechnic system 72. A second input 173B of the pyrotechnic system 72 is connected to the electrical ground.

The first sensor 122 is capable of detecting at each instant, whether the voltage taken downstream from the fuse 130 and upstream from the upstream switch 154 is greater than a determined threshold voltage value, for example greater than at least 10% of the rated voltage delivered by the power battery 88.

The second sensor 124 is capable of detecting, at each instant, whether the voltage measured at the output of the downstream switch 156 and upstream from the downstream safety module 94 is greater than a determined threshold value, for example greater than at least 10% of the voltage value required for triggering the pyrotechnic system.

The third sensor 126 is capable of detecting at each instant, whether an electric current of intensity greater than a threshold value, for example greater than 80% of the intensity required for triggering the pyrotechnic system 72 is flowing on the downstream line 152.

With reference to FIG. 1, the sealing and alignment assembly 34 comprises an airlock 200 mounted on the well head 26, a stuffing box 202 for achieving the seal around the cable 32 and return pulleys 204 respectively attached on the stuffing box 202 and on the well head 26 in order to send back the cable 32 towards the deployment assembly 36.

The airlock 200 is intended to allow introduction of the lower assembly 30 into the well 12.

The stuffing box 202 is capable of achieving a seal around the smooth outer surface of the cable 32, for example via annular linings applied around this surface or/and by injecting a fluid between the outer surface and the wall of the stuffing box 202.

The deployment assembly 36 includes a winch 206 provided with a winder 208. The winch 206 and its winder 208 are laid on the ground or are optionally loaded onboard a vehicle (not shown).

The winch 206 is capable of winding or unwinding a given length of cable 32 for controlling the displacement of the lower assembly 30 in the well 12 when moving up or down respectively.

Figure 4:
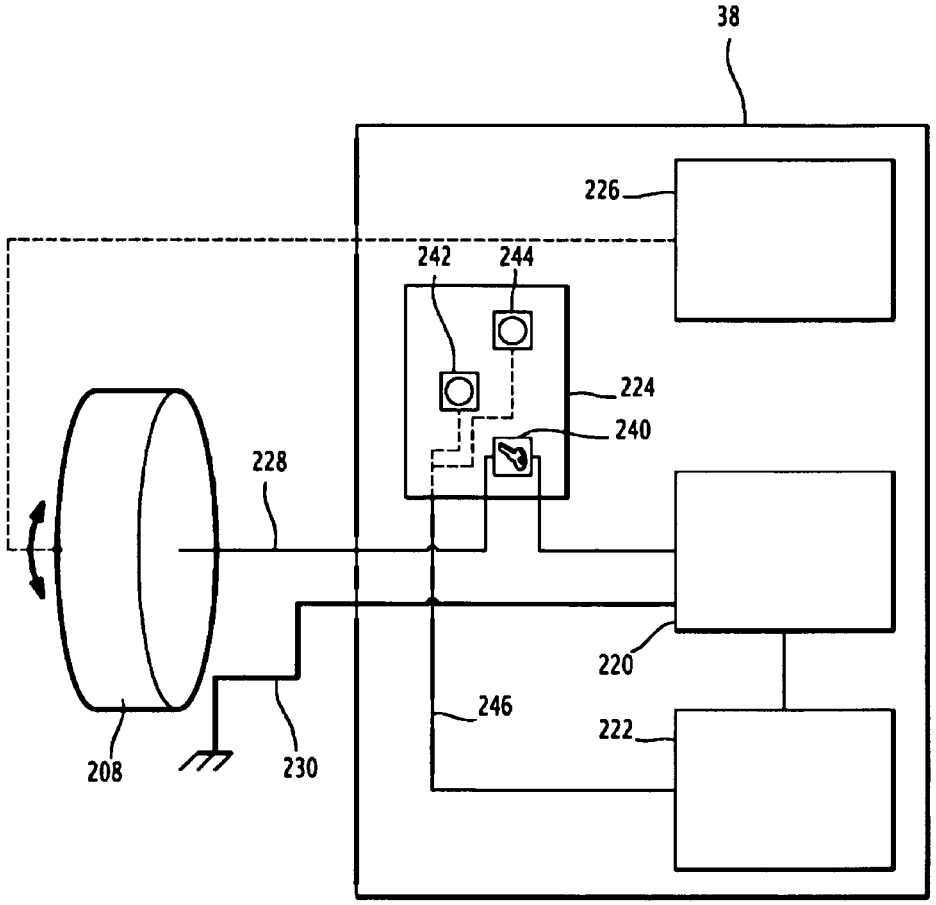
FIG. 4 is a block diagram illustrating the main components of the surface assembly of the installation of FIG. 1.

The upper end 41A of the cable is attached onto the winder 208. As illustrated by FIG. 4, the control unit 38 includes a surface transceiver 220, a control interface 222 and a triggering panel 224.

The control unit 38 further includes a module for controlling the winch 226.

The surface transceiver 220 is electrically connected downstream to the core of the cable 32 via a first electrical surface path 228. It is electrically connected downstream to the well head 26 and to the ducts 20, 22 via a second electrical surface path 230.

The transceiver 220 is electrically connected upstream to the interface 222. It is capable of transmitting and receiving various electrical signals on a current loop defined by the first electrical path 228, the cable 32, the control unit 98, the case 70, the ducts 20, 22, the well head 26, and the second electrical surface path 230.

As this has been seen above, these signals may be the electrical arming signal transmitted from the surface, the electrical triggering signal transmitted from the surface, the electrical signal for controlling the opening of the fuse, these three signals being transmitted from the surface by the transceiver 220. The signals received by the transceiver 220 are for example a signal for receiving a piece of information received from a sensor 108, a signal indicating a voltage at the output of the power battery 88, a signal indicating a voltage at the output of the module 150, and a signal indicating a current at the output of the module 150, these indication signals stemming from the detection component 120.

The interface 222 advantageously comprises a keyboard, a display screen and a central processing unit such as for example a computer.

The triggering panel 224 includes a switch with a key 240, a mechanical button 242 for triggering an explosion, a power-on indicator lamp 244 of the panel.

The key switch 240 is interposed in series on the first electrical surface path 228. When the key switch 240 is open, the transceiver 220 is electrically disconnected from the cable 32.

The triggering panel 224 is connected to the interface 222 via a data communications link 246, for example of the USB cable type, in order to send a signal to the interface 222, upon actuating the button 242.

The operation of the intervention installation 10 according to the disclosure will now be described, during an intervention in a well 12 involving the triggering of a pyrotechnic system 72.

Initially, the deployment assembly 36 and the control unit 38 are brought at the surface 16 to the vicinity of the well head 26. When it is present, the sealing assembly 34 is mounted on the well head 26.

The cable 32 is electrically connected to the control unit 38 via the first electrical path 228, downstream from the triggering panel 224. The cable 32 is then wound around pulleys 204, and is then introduced into the airlock 200 through the stuffing box 202.

The lower assembly 30 is then mounted in the airlock 200 so as to be attached to the lower end 41B of the cable. During this mounting, the cable 32 is electrically connected to the control unit 98 via the connecting head 78.

Next, the airlock 200 is closed and the seal is made around the cable 32 at the stuffing box 202. The well head 26 is then opened in order to lower the lower assembly 30 into the well 12 by unwinding an increasing length of cable 32 out of the winder 208.

The lower assembly 30 thus moves down into the well 12 as far as the desired point of intervention, which may be located in the inner duct 22, beyond the lower end of the inner duct 22, in the outer duct 20, or further directly in the outer duct 20 in the absence of any inner duct 22.

During the downward movement of the lower assembly 30, the measurement sensors 108 present in the lower assembly 30 are advantageously used for positioning the lower assembly 30.

To do this, the key switch 240 is manually closed by an operator at the surface in order to connect the surface transceiver 220 to the cable 228 and to establish a current loop as described earlier.

The signals transmitted by the sensors 108 are then transmitted to the communications unit 98 so as to be transformed into an electrical measurement signal which is conveyed through the cable 32 up to the surface transceiver 220.

When the lower assembly 30 reaches its desired position in the well 12, the winch 206 is immobilized.

Figure 5:
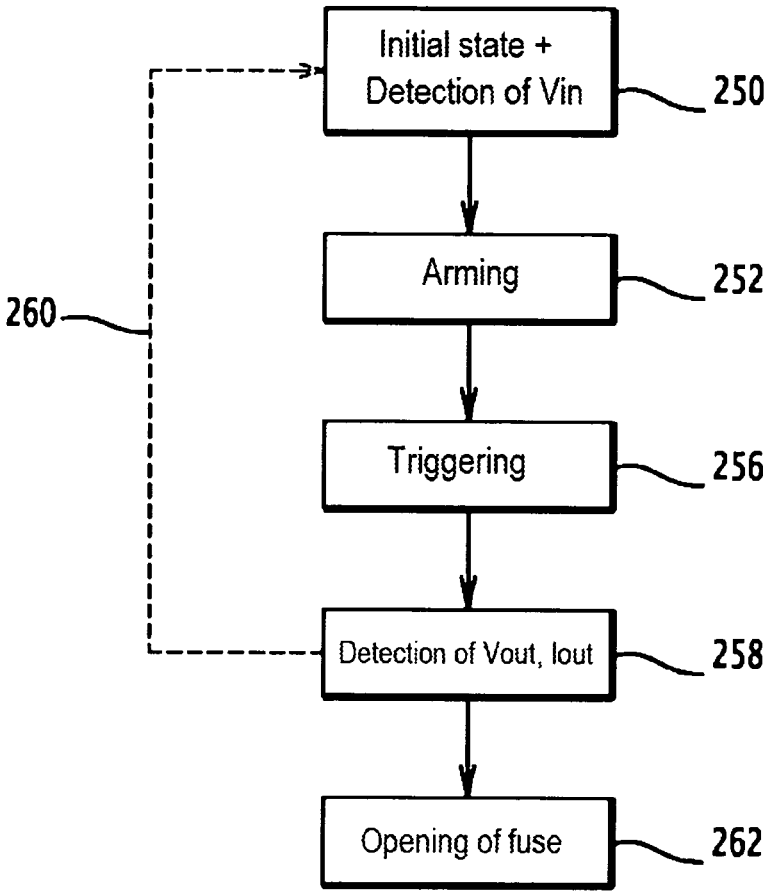
FIG. 5 is a view of a flow chart schematically illustrating the different steps of a method for triggering an explosive charge in the bottom of a well by means of the device illustrated in FIG. 2.

The intervention device is then in an initial state illustrated by step 250 in FIG. 5. In step 252, when the surface operator wishes to trigger the intervention, he/she actuates on the interface 222 a button for triggering arming. The interface 222 then controls the surface transceiver 220 for generating an electrical arming signal and transmitting it as far as the control unit 98 in the lower assembly 30. This signal is transmitted on the current loop established through the first electrical path 228, the cable 32, the control unit 98, the hollow case 70, the centralizers 80, the ducts 20, 22, the well head 26 and the second electrical surface path 230.

The communications unit 98 receives and detects the arming signal and separately transmits it towards the first microcontroller 102A and towards the second microcontroller 102B.

Each microcontroller 102A, 102B then decodes the arming signal and separately transmits it to the logic gate 112 of the circuit 104.

The circuit 104 then toggles from a disabled initial state to a first arming state.

Upon receiving both arming signals from both microprocessors 102A, 102B, the logic gate 112 transmits an arming control signal in order to actuate the control unit 158.

The control unit 158 then closes the upstream switch 154 in order to power on the input of the power module 150 via the upstream line 128.

The logic gate 112 and the control unit 158 thereby form arming means of the power module 150.

Simultaneously, and at a given frequency, for example above 1 Hz, the detection component 120 measures the voltage taken at the sensor 124, downstream from the fuse 130 in order to determine whether this voltage is greater than a determined threshold value.

If this voltage is greater than a determined threshold value, the component 120 then transmits the information to the surface via the communications unit 98 on the current loop as defined above. An indicator is then displayed on the interface 222.

Simultaneously, as the pressure is exerted on the lower assembly 30 and the temperature which prevails around the lower assembly 30 are respectively greater than the threshold pressure and the threshold temperature, the mechanical switches 170, 172 close spontaneously.

In the absence of an additional intervention of the operator at the surface, the circuit 104 remains in the first state for a given duration, for example 1 minute. In particular, the power module 150 remains in its inactive state, so that firing does not take place. If no triggering signal is received during this period, the circuit 104 returns to its initial state.

If the voltage measured by the detection component 120 by means of the first sensor 122 actually indicates that the power battery 88 provides a voltage at the inputs 151A, 153A, of the power module 150, and if the arming command has actually been carried out, the operator at the surface may then trigger the explosion of the charge.

For this purpose, he/she simultaneously actuates with both of his/her hands, the triggering button 242 present on the panel 224 and a control button, for example a keyboard key, present on the interface 222.

The actuation of the button 242 is transmitted to the interface 222 through the communications link 246. The interface 222 then actuates the transceiver 220 so that it transmits a triggering signal in step 256.

This triggering signal is then transmitted to the communications unit 98 through the current loop defined above and comprising the cable 32.

The triggering signal is then transmitted to the microcontrollers 102A, 102B arranged in parallel. Each microcontroller 102A, 102B analyses the received triggering signal and transmits it separately to the second logic gate 114 of the programmable logic circuit 104.

Upon receiving each triggering signal received from the microcontrollers 102A, 102B, and if the circuit 104 is already in its first arming state, the circuit 104 then toggles into a second state, a so called triggering state. The second logic gate 114 then transmits a triggering control signal which is transmitted to the unit for controlling triggering 160.

The unit 160 then actuates the module 150 in order to convert the input voltage provided by the power battery 88 through the upstream line 128 into an output voltage on the downstream line 152, greater than the input voltage.

The second logic gate 114 and the control unit 160 thereby form means for triggering the pyrotechnic system 72.

When the output voltage of the converter 150 exceeds a threshold value, the threshold switch 156 closes. The switches 170, 172 being closed, the converter 150 applies the output voltage to the terminals of the pyrotechnic system 72.

In the case when the system comprises a detonator 82, the latter is electrically connected to the converter, so that an electrical current flows on the downstream line 152 between the power module 150 and the detonator 82. This electrical current then allows triggering of the explosive charge 84 thereby causing firing and explosion in step 258.

The detection sensor 124 then detects the presence of an output voltage downstream from the threshold switch 156, and the detection sensor 126 detects the presence of an electric current with a greater intensity than the threshold intensity on the downstream line 152.

The component 120 then transmits respective confirmation signals to the control unit 38 at the surface through the communications unit 98 and the current loop described earlier.

Further, the detection, at least at a given instant, of a voltage above the threshold voltage at the output of the threshold switch 156 and, at least at a given instant, of a current with an intensity greater than a threshold intensity flowing in the downstream line 152 allows the operator to check whether an electrical voltage has been applied to the pyrotechnic system 72 and that an electrical current above a threshold has flowed through the pyrotechnic system 72.

The circuit 104 again toggles automatically from its triggering state to the initial state after a set period, for example comprised between 5 and 60 seconds.

As indicated by the arrow 260 in FIG. 5, it is then possible to again trigger the explosion of another pyrotechnic system 72, if such a system is present or if the pyrotechnic system has not functioned according to expectations.

Once the operation in the well is finished, the operator at the surface actuates the opening of the fuse in step 262 with the interface 222. A control signal for opening the fuse is then transmitted from the surface transceiver 220 through the cable 32 as far as the communications unit 98.

This signal is relayed by the unit 98 as far as the microcontrollers 102A, 102B. Each microcontroller 102A, 102B decodes the received information and transmits a respective signal for opening the fuse, to the logic gate 116.

As soon as the logic gate 116 receives at least one of the opening signals, it produces an opening control signal which is transmitted to the control unit 134.

The unit 134 then closes the leak switch 132 so as to form a short circuit between the power battery 88, the fuse 130, a resistor and the electrical ground through the leak switch 132.

This current of great intensity causes the opening of the fuse 130.

This having been done, the detection component 120 no longer detects any voltage with the first sensor 122 and transmits this information to the surface via the communications unit 98. Once this information has been received at the surface, the operator raises the lower assembly 30 with the winch 206 safely, without being able to retrigger the system.

Moreover, the fuse 130 may be open at any instant during the method described earlier, if the operator estimates this necessary, by generating a control signal for opening the fuse from the surface unit 38 as this has been described.

In one alternative, the opening of the fuse 130 is also generated automatically by the synchronization component 118, if one of the two microcontrollers 102A, 102B no longer transmits any synchronization pulses or if the clock no longer operates.

The opening of the fuse 130 is also controlled automatically by the microcontrollers 102A and 102B in the absence of communications between the control unit 38 at the surface and the lower assembly 30 during a given period of time for example of more than two hours.

Moreover, the opening of the fuse 130 may also be controlled automatically when the auxiliary battery 96 no longer delivers sufficient voltage. The voltage of the auxiliary battery is measured by the microcontrollers 102A and 102B. When the voltage of the auxiliary battery decreases below a certain threshold for example 2V, the microcontrollers 102A and 102B automatically control the opening of the fuse.

By means of the invention which has just been described, it is therefore possible to proceed in an extremely safe way with an intervention in a well 12 having a pyrotechnic system 72, while using a deployment system which is simple to apply.

This considerably reduces the cost of the operation, while increasing safety, the triggering of the charge only being carried out after finalization of the safety arming step.

In one alternative, the cable 32 comprises two parallel electrical paths electrically insulated from each other. The communications unit 98 and the transceiver 220 are each connected to both paths in order to establish a current loop between these paths, without passing through the ducts 20, 22.

Still more generally, the cable 32 is a cable having a smooth outer surface capable of transmitting data.

In one alternative, the lower assembly 30 includes two pyrotechnic systems 72 connected to the same power module 150 configured for each connected pyrotechnic system. Both systems may be triggered separately, advantageously one with a positive voltage and the other one with a negative voltage.

In another embodiment, after having received an arming command and a delayed triggering command, the logic circuit 104 triggers in a self-contained way the power module 150 after a time-out with a determined period of time, for example programmed during the manufacturing of the lower assembly 30.

This embodiment is useful in the case when the lower assembly 30 is located in an area where communication between the control unit 38 at the surface and the module 86 is not working. A delayed triggering command is sent into an area of the well where communication is possible between the control unit 38 and the module 86, and then the lower assembly is lowered to the intended depth in order to trigger the pyrotechnic system 72.

The invention claimed is:

1. A device for intervention in a well of the type comprising:

a lower assembly intended to be lowered into the well, the lower assembly including at least one pyrotechnic system, and an assembly for firing the pyrotechnic system, the firing assembly comprising a power module having an output intended to be electrically connected to the pyrotechnic system for causing the firing of the pyrotechnic system, and a power battery intended to be connected to an input of the power module in order to provide the required electric power to the power module, the firing assembly further including a module for controlling the power module; and a cable for deploying the lower assembly in the well, electrically connected to the control module, wherein the control module includes:

first detection means capable of determining whether a voltage greater than a first threshold value is provided by the power battery to the power module;

means for arming the power module capable of connecting the power battery to an input of the power module for applying an electrical voltage at the input of the power module upon receiving an electrical arming signal transmitted from the surface through the deployment cable;

means for triggering the pyrotechnic system, capable of connecting an output of the power module to the pyrotechnic system in order to provide an output voltage capable of generating the firing of the pyrotechnic system, upon receiving a distinct electrical triggering signal posterior to the arming signal, the triggering signal being transmitted from the surface through the deployment cable.

2. The device according to claim 1 wherein the control module comprises second detection means capable of determining whether a voltage greater than a second threshold value has been produced at an output of the power module and third detection means capable of determining whether an electrical current for powering the pyrotechnic system greater than a third threshold value has flowed via the power module between the battery and the pyrotechnic system, after sending the triggering signal.

3. The device according to claim 1, wherein the control module includes a programmable logic control circuit, advantageously of the Field-Programmable Gate Array (FPGA) type, capable of passing from an initial state to a first state for actuating the arming means of the power module upon receiving the electrical arming signal and then to a second state for actuating the triggering means upon receiving the electrical triggering signal, the transition of the card to the second actuation state only being possible after the transition of the card into the first actuation state.

4. The device according to claim 3, wherein the arming means comprise at least one first logic gate of the logic circuit, the triggering means comprise at least one second logic gate of the logic circuit.

5. The device according to claim 1, wherein the control module includes at least one first controller, and at least one second controller mounted in parallel on the first controller, the first controller and the second controller respectively receiving in parallel an electrical arming signal for transmitting it to the arming means, the arming means being actuated upon receiving at least either one of the arming signals from the first controller and from the second controller, and in that the first controller and the second controller receive in parallel the triggering signal in order to transmit it to the triggering means, the triggering means being actuated upon receiving at least either one of the triggering signals from the first controller and from the second controller.

6. The device according to claim 5, wherein a fuse is electrically interposed between the power battery and the power module in order to prevent the power module from being powered by the power battery when the fuse is open, the control module comprising means for controlling the opening of the fuse and wherein the means for controlling the opening of the fuse are capable of being actuated when at least one of the first controller and of the second controller has a fault.

7. The device according to claim 1, wherein a fuse is electrically interposed between the power battery and the power module in order to prevent the power module from being powered by the power battery when the fuse is open, the control module comprising means for controlling the opening of the fuse.

8. The device according to claim 7, wherein the means for controlling the opening of the fuse are capable of being actuated upon receiving a signal for opening the fuse from the surface through the cable.

9. The device according to claims 6, wherein the control module is electrically powered by an auxiliary battery borne by the lower assembly, and distinct from the power battery, the control module comprising fourth means for indicating the presence of a voltage at the output of the auxiliary battery, the means for controlling the opening of the fuse being capable of actuating the opening of the fuse when the fourth indication means detect a voltage less than a threshold value at the terminals of the auxiliary battery.

10. The device according to claim 6, wherein the means for controlling the opening of the fuse are capable of being actuated in the absence of receiving by the control module a communications signal from the surface through the cable over a predetermined period of time.

11. The device according to claim 1, wherein the lower assembly includes at least one mechanical switch positioned in series between the power battery, the power module, and the pyrotechnic system, said or each mechanical switch being capable of closing spontaneously when the temperature and/or the pressure applied on the switch are greater than a determined temperature and/or determined pressure.

12. The device according to claim 1, wherein the deployment cable has a smooth outer surface, the cable comprising a solid metal core and an electrically insulating sheath defining the smooth outer surface of the cable, the core having a breaking strength of more than 300 daN and an electrical linear resistance of more than 30 mohms/m, the electrical arming signal and the electrical triggering signal being conveyed through the cable.

13. The device according to claim 1, wherein the power module comprises a tension converter able to increase an input tension received from the power battery between its inputs to supply a higher output tension.

14. A method for triggering a pyrotechnic system in a well of the type comprising the following steps:

providing a device according to claim 1;

lowering the lower assembly into the well with the deployment cable;

detecting with the first detection means a voltage threshold applied at the input of the power module;

sending an electrical arming signal from the surface and transmitting this electrical arming signal to the control module through the cable;

actuating the arming means and powering on the power module by the power battery in order to apply an electrical arming voltage to an input of the power module;

transmitting a distinct electrical triggering signal posterior to the arming signal from the surface and transmitting this electrical triggering signal to the control module through the deployment cable;

actuating the triggering means and electrically powering the pyrotechnic system by the power module in order to generate the firing of the pyrotechnic system;

detecting with the detection means a voltage threshold applied at the output of the power module;

detecting with detection means an intensity threshold of electric current flowing between the battery and the pyrotechnic system.

15. An installation for intervention in a well, wherein it includes a device for intervention in a well and a surface assembly, wherein the device for intervention in a well is of the type comprising:

a lower assembly intended to be lowered into the well, the lower assembly including at least one pyrotechnic system, and an assembly for firing the pyrotechnic system, the firing assembly comprising a power module having an output intended to be electrically connected to the pyrotechnic system for causing the firing of the pyrotechnic system, and a power battery intended to be connected to an input of the power module in order to provide the required electric power to the power module, the firing assembly further including a module for controlling the power module; and a cable for deploying the lower assembly in the well, electrically connected to the control module, wherein the control module includes:

first detection means capable of determining whether a voltage greater than a first threshold value is provided by the power battery to the power module;

means for arming the power module capable of connecting the power battery to an input of the power module for applying an electrical voltage at the input of the power module upon receiving an electrical arming signal transmitted from the surface through the deployment cable;

means for triggering the pyrotechnic system, capable of connecting an output of the power module to the pyrotechnic system in order to provide an output voltage capable of generating the firing of the pyrotechnic system, upon receiving a distinct electrical triggering signal posterior to the arming signal, the triggering signal being transmitted from the surface through the deployment cable, and wherein the surface assembly includes means for transmitting an electrical arming signal and a distinct triggering signal posterior to the arming signal, the transmission means being electrically connected to the cable.

16. The installation according to claim 15, wherein it includes an interface for controlling the transmission means and a mechanical switch interposed between the transmission means and the cable, the mechanical switch being advantageously manoeuvred with a control key between a position for electrically connecting the transmission means with the cable and a position for disconnecting the transmission means from the cable.

* * * * *